US007107621B2

(12) United States Patent
Meekins

(10) Patent No.: US 7,107,621 B2
(45) Date of Patent: Sep. 19, 2006

(54) OPTICAL ILLUSION WEAR

(76) Inventor: Frank Meekins, 6832 Running Springs Ct., Frederick, MD (US) 21703-5820

( * ) Notice: Subject to any disclaimer, the term of this patent is extended or adjusted under 35 U.S.C. 154(b) by 0 days.

(21) Appl. No.: 10/860,676

(22) Filed: Jun. 3, 2004

(65) Prior Publication Data

US 2005/0268371 A1 Dec. 8, 2005

(51) Int. Cl.
*A41D 1/00* (2006.01)
*A41D 7/00* (2006.01)

(52) U.S. Cl. ..... 2/69; 2/67; 2/115; 2/731; 2/737

(58) Field of Classification Search ..... 2/67, 2/69, 115, 80, 106, 243.1, 244, 246, 93, 94, 2/102, 171, 209.13, 200.1, 227, 238, 79; D2/731, 734, 737, 738, 829, 840, 999; 40/427, 40/586; 472/57, 72
See application file for complete search history.

(56) References Cited

U.S. PATENT DOCUMENTS

| | | | | | |
|---|---|---|---|---|---|
| 1,654,064 | A | * | 12/1927 | Zaki | 2/239 |
| 1,697,255 | A | * | 1/1929 | Wolff | 66/182 |
| 1,817,053 | A | * | 8/1931 | Zerk | 2/239 |
| 1,852,138 | A | * | 4/1932 | Zerk | 28/154 |
| D94,420 | S | * | 1/1935 | Hayman | D2/731 |
| D121,239 | S | * | 6/1940 | Solomon | D2/731 |
| D180,608 | S | * | 7/1957 | Mansueto | D2/734 |
| D181,419 | S | * | 11/1957 | Mansueto | D2/734 |
| 3,683,419 | A | * | 8/1972 | Lewis | 2/67 |
| 3,691,971 | A | * | 9/1972 | Clarke | 428/30 |
| 3,696,845 | A | * | 10/1972 | Acker et al. | 139/383 R |
| D278,474 | S | * | 4/1985 | Briggery Myles | D2/734 |
| 4,856,857 | A | * | 8/1989 | Takeuchi et al. | 359/3 |
| 4,876,121 | A | * | 10/1989 | Cohen | 428/15 |
| 5,065,458 | A | * | 11/1991 | Johnson | 2/69 |
| 5,083,316 | A | * | 1/1992 | Kuehner | 2/67 |
| 5,515,542 | A | * | 5/1996 | Simmons | 2/67 |
| 6,279,161 | B1 | * | 8/2001 | Johnston | 2/69 |
| 2005/0134035 | A1 | * | 6/2005 | Chavez | 283/67 |

FOREIGN PATENT DOCUMENTS

WO WO 03/092826 A1 * 11/2003

OTHER PUBLICATIONS

"Optical Illusion T-Shirt", http://mistupid.com online store, Dec. 10, 2003 (dated by Internet Archive WayBack Machine of www.archive.org).*
"Spinner" T-shirt, http://www.zazzle.com, for sale date of Mar. 20, 2003.*
"Magic Eye Dragons" T-Shirt http://www.zazzle.com, for sale date of Aug. 15, 2003.*
"Illusion—Black Dots" T-shirt, http://www.zazzle.com, for sale date of Dec. 7, 2001.*

* cited by examiner

*Primary Examiner*—A. Vanatta
(74) *Attorney, Agent, or Firm*—SAIDMAN DesignLaw Group

(57) ABSTRACT

The present invention is a variety of wearing apparel which employs two-dimensional patterns of optical illusions in three-dimensional applications in or upon the material of said wearing apparel. The applications of said patterns in the design of the apparel are for the purposes of a) novelty, b) highlighting body areas for attention and/or c) creating bodily appearance modification based on the natural properties of the optical illusion pattern itself.

15 Claims, 2 Drawing Sheets

Slimming

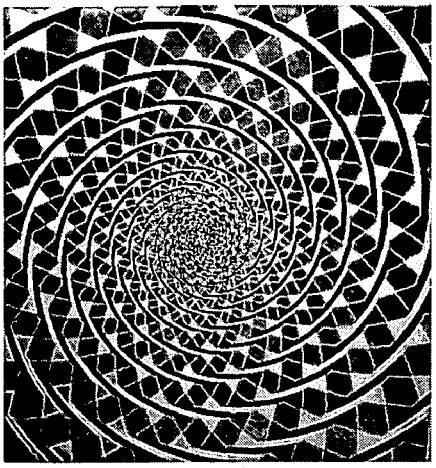
Fig 1- Spiral Illusion
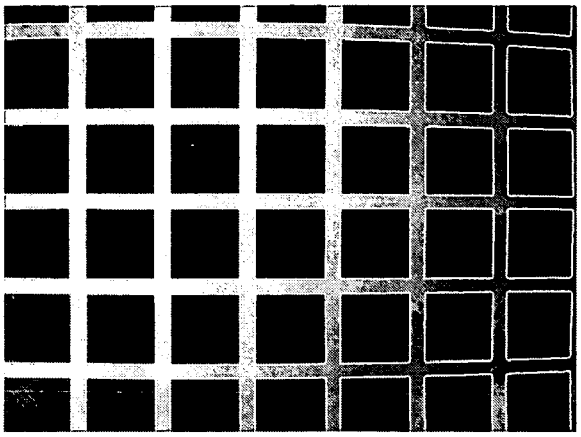
Fig 2 – Scintillating Grid with Visual Phantoms
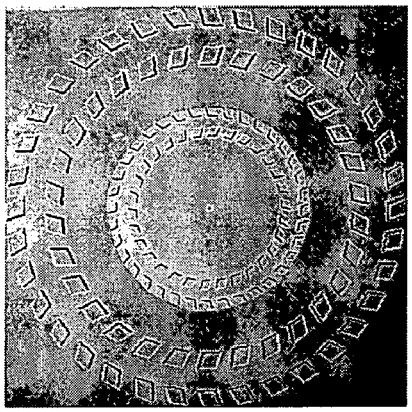
Fig 3 – Anomalous Motion Illusion
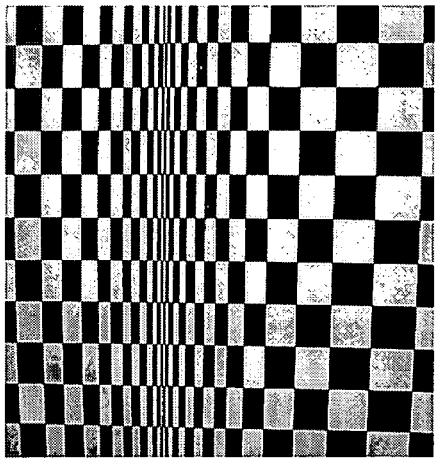
Fig 4 – Chasm Geometric Illusion
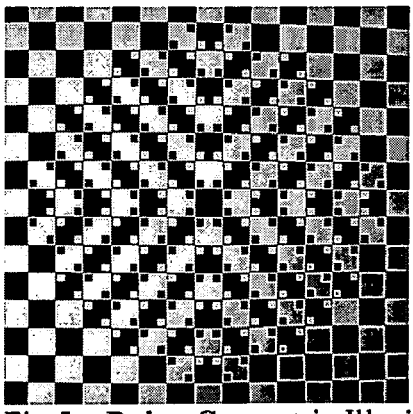
Fig 5 – Bulge Geometric Illusion

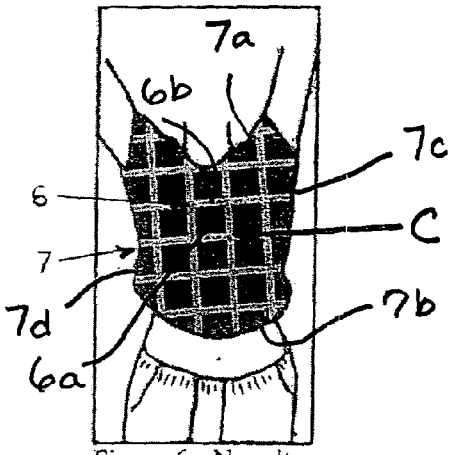
Figure 6 - Novelty
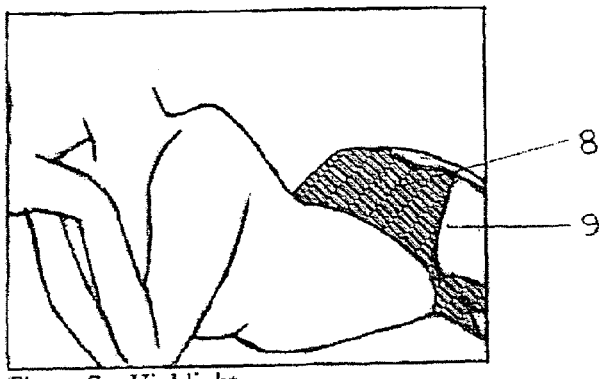
Figure 7 – Highlight
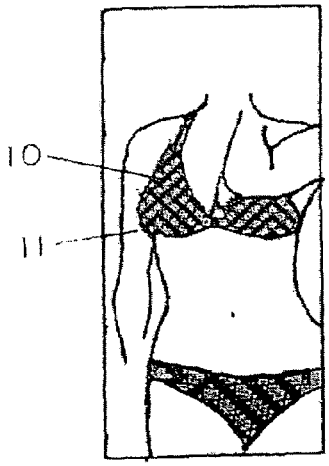
Figure 8 - Enlarging
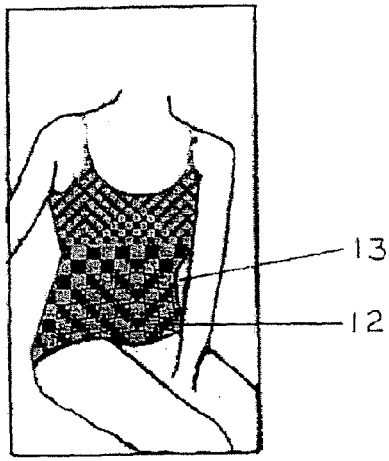
Figure 9 – Slimming

OPTICAL ILLUSION WEAR

FIELD OF THE INVENTION

The present invention relates to the field of wearing apparel. More specifically, the present invention is a type of wearing apparel employing patterns of optical illusion visibly incorporated in or upon the fabric thereof.

BACKGROUND OF THE INVENTION

In the field of wearing apparel, garments have been developed in various styles, patterns and colors, typically with the intent to produce a desired visual effect. That effect has sometimes been one of form flattering or form altering attire, such as fitted shirts and corsets, or of body hiding such as camouflage. Other effects have been related to expressions of interests or points of view such as in the use of words or artistic patterns or to novelty such as in costumes.

Horizontal, vertical, and diagonal line and stripe patterns have been used, as have been geometric shapes, plaids, and checkerboard shapes. Patterns in the shapes of animate and inanimate objects as well as abstract art and symbols have been used to create specific impacts. Contrasts from the darkest darks to the lightest lights and patterns mixing black, white and colors have been employed for the purpose of creating various design results.

Some of the pattern effects tend to create optical illusions. As can be seen from a study of prior art, it has been found that garments featuring barely perceptible shading progressions (U.S. Pat. No. 1,817,053 to Zerk) and changes of color across their surfaces (U.S. Pat. No. 4,282,609 to Freedman) can provide a shapely effect due to an illusion of shadowing. Appearance modifying garments have also been developed utilizing appearance enhancing color differences to promote an improved shape of the wearer through the formation of apparent marginal edges on the garment itself (Refer to U.S. Pat. No. 5,065,458 to Johnson).

However, a concept that has yet to be developed is that of clothing created from fabric containing patterns of optical illusions themselves for specific purposes. Therefore, as an enhancement to the current state of the art, the present invention is a style of wearing apparel which employs patterns of optical illusions for the purposes of novelty, to highlight body areas and/or to create bodily appearance modification based on the natural properties of the optical illusion pattern itself.

SUMMARY OF THE INVENTION

A style of wearing apparel is disclosed which employs within or upon the material of said apparel, patterns which exhibit the properties of optical illusions. An optical illusion is an optical phenomenon that results in a false or deceptive visual impression. It can be a drawing or pattern that appears to have an effect that it does not really have or it can be something that appears different than it actually is. An example of an optical illusion would be when a flat painting seems to have three-dimensional depth.

Optical illusions comprise design types including: geometric, spiral, anomalous motion, rotational, color change, peripheral drift, positive after image blurs, scintillation grid, stereopsis and chromosteropsis, contraction & expansion, contrast polarities, convection, chromatic assimilation, etc. In the present invention, said patterns are visibly incorporated into or onto the fabric from which a garment is manufactured. As the garment is worn on a three-dimensional form, the pattern continues to exhibit its illusionary properties.

In a first exemplary application, the wearing apparel employs fabric comprising patterns of optical illusion strictly for the purpose of novelty. A pattern is chosen which exhibits an illusionary phenomenon of any variety. The wearer displays the pattern for the purpose of receiving attention from the visual stimulation of the pattern only. An example of this would be a shirt with an anomalous motion pattern situated on the front or back of the garment. A viewer's attention might be drawn first to the image and then to the novel illusion associated with the image.

In a second exemplary application, the patterns are positioned on a garment such that, as attention of a viewer is drawn to the illusion associated with the pattern, the body part concealed by or adjacent to the area of the pattern is emphasized to the viewer. For example, a rotational pattern might be situated on the seat of a swimsuit, drawing a viewer's attention to that part of the wearer's anatomy.

In a third application, said patterns of optical illusion may be employed for the purpose of visual appearance modification. This may be based on a combination of the natural properties of the optical illusion pattern itself and the location of said pattern upon the wearer. For example, a woman's breasts may appear larger under the application of an expansion illusion pattern located on the bust cover of a swimsuit.

In the exemplary embodiments described above, the idea of patterns employed in clothing for humans is indicated; however, the application of optical illusions within apparel for non-humans (e.g., dogs) may be employed without departing from the teachings of the present invention.

BRIEF DESCRIPTION OF THE DRAWINGS

Exemplary embodiments of the invention are discussed hereinafter in reference to the following drawings, in which photographs of pertinent optical illusions have been used as the only practicable medium for illustrating certain details of the claimed invention, and in which:

FIGS. 1 through 5 are samples of two-dimensional optical illusions.

FIG. 6 is an illustration of a garment employing a pattern of optical illusion for the purposes of novelty.

FIG. 7 is an illustration of a garment employing a pattern of optical illusion for the purposes of drawing attention to specific body areas.

FIG. 8 is an illustration of a garment employing a pattern of optical illusion for the purposes of appearing to enlarge a specific body area.

FIG. 9 is an illustration of a garment employing a bulging pattern of optical illusion on one body area for the purposes of appearing to slim an adjacent body area.

DETAILED DESCRIPTION OF PREFERRED EXEMPLARY EMBODIMENTS

The present invention is a variety of wearing apparel comprised principally of cloth fabric or any suitable materials of manufacture upon or within which exist one or more visible optical illusion patterns.

As shown in the samples in FIGS. 1 through 5, optical illusions are unreal, deceptive or misleading appearances or images which a viewer effectively "sees" as a result of viewing illusionary patterns designed to produce such appearances or images. Illusionary patterns employed in the manufacture of the wearing apparel of the present invention typically exist, prior to their use in said apparel, in two dimensional portrayals which may comprise any or a plurality of types common to those familiar with the art form. These types may include: geometric, spiral, anomalous motion, rotational, color change, peripheral drift, positive after image blurs, scintillation grid, stereopsis and chromosteropsis, contraction & expansion, contrast polarities, convection, chromatic assimilation, etc. Said patterns may exist in color or black and white representations as necessary to generate their illusionary properties. Specific patterns depicted in FIGS. 1 through 5 are as follows:

FIG. 1 depicts a spiral illusion pattern. In this pattern, the predominant circular lines appear to be spiraling inward toward the center of the pattern. In reality, the lines are actually independent circles, not spirals.

FIG. 2 depicts a scintillating grid with visual phantoms pattern. A viewer focusing on the center of a white cross area of the pattern will "see" phantom dots appearing at the centers of adjacent and subsequent cross areas. The dots are only visible through the viewer's peripheral vision and will disappear if the viewer shifts his focus to said areas.

FIG. 3 depicts an anomalous motion illusion pattern. If a viewer moves his head toward and away from the surface of the image while focusing on the center of the pattern, he will appear to "see" the concentric circles of the pattern appear to rotate in alternating directions.

FIG. 4 depicts a chasm geometric illusion pattern. This image is comprised of two identical checkerboard patterns which originate from two directions toward each other from opposite sides of a two-dimensional plane perpendicular to the line of sight of the viewer. As the two patterns approach each other, they appear to begin to curve away from the viewer avoiding a convergence until they reach a point some distance away from said two-dimensional plane.

FIG. 5 depicts a bulge geometric illusion pattern. This pattern, while it exists in two dimensions, appears to bulge out of the page toward the viewer. Such a pattern creates an appearance of enlargement to an area covered by such a pattern or may create the impression of slimming for an area adjacent to a portion of the bulging pattern.

Patterns chosen for use in the variety of apparel of the present invention will exhibit their two-dimensional illusionary properties when also used in three dimensional applications such as upon clothing for the human body. That is to say the properties of illusion the pattern exhibits in a flat, two-dimensional portrayal remain obvious when the pattern is displayed on a three dimensional or shapely surface.

In a first exemplary embodiment of the present invention as shown in FIG. 6, a scintillating grid (refer to FIG. 2) applied optical illusion pattern (6) is present upon a garment (7) of wearing apparel. The garment (7) is formed of a material including a visible surface defined by spaced apart outer edges (7*a*, 7*b*, 7*c*, 7*d*). The visible surface includes a center area C. The pattern and its location on the garment in this embodiment are intended to function as a novelty interest generator in the wearing apparel. The optical illusion pattern, which draws attention to itself solely because of its visual phantom ("dots") illusionary properties, is positioned to be displayed prominently upon the exposed surface of the garment. Said prominent positions include the front, back, top, bottom or sides of the exterior of any garment of apparel. The attention of a viewer is drawn first to the pattern displayed on said apparel and secondly to the optical illusion associated with the pattern in the satisfaction of said viewer's interest in the novelty thereof.

A plurality of first and second areas (6*a*, 6*b*) are organized into an applied optical illusion pattern (6). The plurality of first areas (6*a*) are a first color and the plurality of second areas (6*b*) are a second color. The first color is darker than the second color. The plurality of first and second areas (6*a*, 6*b*) alternate in the applied optical illusion pattern (6), and at least a portion of the plurality of first areas (6*a*) are located in the center area C. In addition, the applied optical illusion pattern extends from the center area C adjacent to at least one of the outer edges (7*a*, 7*b*, 7*c*, 7*d*).

In a second exemplary embodiment of the present invention as shown in FIG. 7, the choice and placement of the optical illusion pattern (8) is intended to highlight or draw attention to certain body areas of the wearer. As can be seen in FIG. 7, the pattern is located upon the garment (9) so as to visibly cover or be situated adjacent to said body areas when said garment is worn. As a viewer's attention is drawn to the illusionary pattern on the garment, it also tends to be drawn to the associated body area, in this case, the wearer's buttocks, resulting in the intended attention.

In a third exemplary embodiment, the illusionary patterns are intended to be placed upon garments so as to alter the apparent image of the body. This may be accomplished by selecting patterns which exhibit properties such as enlargement or reduction and employing them in strategic locations upon said garments. Bulging patterns (FIG. 5) tend to create the illusion of enlargement or bulging of the surface upon which the pattern resides. As shown in FIG. 8, a bulging pattern (10) is chosen to enhance such areas as a woman's breasts (11). Other patterns tend to create a contraction or reducing effect. As shown in FIG. 9, a bulging pattern (12) is employed for a slimming effect in such areas as the torso (13). Positioning the top half of the bulging pattern at a point on the lower torso tends to make the wearer's body above the bulging pattern appear slimmer.

In the examples cited above, enlarging and slimming patterns are used to demonstrate the use of optical illusion patterns in the appearance altering function of the exemplary embodiment. However, patterns exhibiting other form altering effects may be employed without departing from the teaching of the present invention.

Materials of manufacture may be of any type of cloth or other fabric, or any other materials suitable for use as wearing apparel for any purpose. Pattern transfer to the fabric and manufacture of the apparel may be accomplished by any method common to those skilled in the art.

Because many varying and different embodiments may be made within the scope of the inventive concept herein taught, and because many modifications may be made in the embodiments herein detailed in accordance with the descriptive requirements of the law, it is to be understood that the details herein are to be interpreted as illustrative and not in a limiting sense.

What is claimed is:

1. An article of wearing apparel comprising:

material including only opaque qualities and a visible surface defined by spaced apart outer edges, said visible surface including a center area; and an applied optical illusion pattern permanently associated with said visible surface of said material, said applied optical illusion pattern formed by a plurality of first and second areas, said plurality of first areas being a first color and said plurality of second areas being a second color wherein said first color is darker than said second color, said applied optical illusion pattern including a plurality of rows and a plurality of columns, each row including one of said first areas adjacent one of said second areas and each column including one of said first areas adjacent one of said second areas and a portion of said plurality of first areas are located in said center area, and said applied optical illusion pattern extends from said center area adjacent to one of said outer edges.

2. The article of wearing apparel of claim 1 wherein said apparel may be of any type or style and manufactured from any fabric or other suitable material upon or within which said applied optical illusion pattern may be placed.

3. The article of wearing apparel of claim 1 wherein said first and second colors are selected from the group consisting of: black and white, and color.

4. The article of wearing apparel of claim 1, wherein said applied optical illusion pattern is selected from the group consisting of:

geometric;
spiral;
anomalous motion;
rotational;
color change;
peripheral drift;
positive after image blurs;
scintillation grid;
contraction & expansion;
contrast polarities; and
convection.

5. The article of wearing apparel of claim 1, wherein said applied optical illusion pattern is located on said visible surface to draw attention to said applied optical illusion pattern.

6. The article of wearing apparel of claim 1, wherein said applied optical illusion pattern is located strategically on said visible surface to cover or exist adjacent to a specific body area.

7. The article of wearing apparel of claim 6 wherein said strategic location of said applied optical illusion pattern is to draw attention to said specific body area covered or adjacent to said applied optical illusion pattern.

8. The article of wearing apparel of claim 1, wherein said applied optical illusion pattern includes a first shape, and said article of wearing apparel further includes:

a viewed optical illusion pattern different from said applied optical illusion pattern, in said viewed optical illusion pattern said first shape appears to be a second shape different from said first shape;

wherein said viewed optical illusion pattern results from observing said applied optical illusion pattern.

9. The article of wearing apparel of claim 1, wherein said applied optical illusion pattern includes an element that is stationary, and said article of wearing apparel further includes:

a viewed optical illusion pattern different from said applied optical illusion pattern, in said viewed optical illusion pattern said element appears to be moving;

wherein said viewed optical illusion pattern results from observing said applied optical illusion pattern.

10. The article of wearing apparel of claim 1, wherein said applied optical illusion pattern includes an element that is two-dimensional, and said article of wearing apparel further includes:

a viewed optical illusion pattern different from said applied optical illusion pattern, and in said viewed optical illusion pattern said element appears to be three-dimensional;

wherein said viewed optical illusion pattern results from observing said applied optical illusion pattern.

11. The article of wearing apparel of claim 1, wherein said visible surface defined by said outer edges further includes a first set of outer edges vertically spaced apart and a second set of outer edges transversely spaced apart, and said applied optical illusion pattern extends from said center area adjacent to said first and second sets of outer edges.

12. The article of wearing apparel of claim 11, wherein said plurality of rows and said plurality of columns extend adjacent to said first and second sets of outer edges.

13. The article of wearing apparel of claim 11, wherein said applied optical illusion pattern extends on the entirety of said visible surface.

14. The article of wearing apparel of claim 1, further including a plurality of third areas, said first, second and third areas being organized into said applied optical illusion pattern, said plurality of third areas being a third color different from said first and second colors, said applied optical illusion pattern including a plurality of rows and a plurality of columns, each row including one of said first areas adjacent one of said second and third areas and each column including one of said first areas adjacent one of said second and third areas.

15. The article of wearing apparel of claim 14, wherein said applied optical illusion pattern is a spiral.

* * * * *